US006748628B2

(12) United States Patent
Sauter et al.

(10) Patent No.: US 6,748,628 B2
(45) Date of Patent: Jun. 15, 2004

(54) LATCHED SNAP-IN CONNECTION

(75) Inventors: Christian Sauter, Embrach (CH); Paul Cahannes, Embrach (CH); Peter Weber, Gräslikon (CH)

(73) Assignee: Maschinenfabrik Rieter AG, Winterthur (CH)

( * ) Notice: Subject to any disclaimer, the term of this patent is extended or adjusted under 35 U.S.C. 154(b) by 0 days.

(21) Appl. No.: 10/176,108

(22) Filed: Jun. 20, 2002

(65) Prior Publication Data

US 2003/0092522 A1 May 15, 2003

(30) Foreign Application Priority Data

Jun. 21, 2001 (CH) ..... 1130/01
Mar. 5, 2002 (DE) ..... 102 09 579

(51) Int. Cl.[7] ..... D01G 15/12
(52) U.S. Cl. ..... 19/113; 19/102; 19/111
(58) Field of Search ..... 19/98, 102, 103, 19/105, 107, 108, 110, 111, 112, 113, 114

(56) References Cited

U.S. PATENT DOCUMENTS 2,627,756 A 2/1953 Bendall
4,799,919 A 1/1989 Kozachevsky et al.
4,827,573 A * 5/1989 Kuehl ..... 19/102
4,982,478 A 1/1991 Stahli et al.
5,473,795 A 12/1995 Spix et al.
5,542,154 A 8/1996 Demuth et al.
5,956,811 A 9/1999 Cahannes et al.
6,431,969 B1 8/2002 Sauter et al.

FOREIGN PATENT DOCUMENTS

CH 0 753 610 A1 * 1/1997 ..... D01G/15/24
CH 1 270 777 A1 * 6/2002 ..... D01G/15/24
DE 9414196.7 6/1995
DE 19534617 4/1996
DE 19834893 2/2000
EP 0627527 B1 12/1994
WO 9916579 4/1999
WO 0013850 3/2000

OTHER PUBLICATIONS

EPO Search Report, Sep. 25, 2002.
U.S. patent application Publication No. 2002/0088093, Jul. 11, 2002.

* cited by examiner

*Primary Examiner*—Gary L. Welch
(74) *Attorney, Agent, or Firm*—Dority & Manning

(57) ABSTRACT

A drive belt assembly for a revolving flat card includes a flexible belt. At least a pair of connecting elements are integrally formed with the belt. The connecting elements include a cross-beam with an inclined surface. A locking element is disposed between the pair of connecting elements in order to prevent the connecting elements from approaching one another. The locking element is removable from the pair of connecting elements to allow for the approaching of the connecting elements to one another.

20 Claims, 6 Drawing Sheets

Fig.4
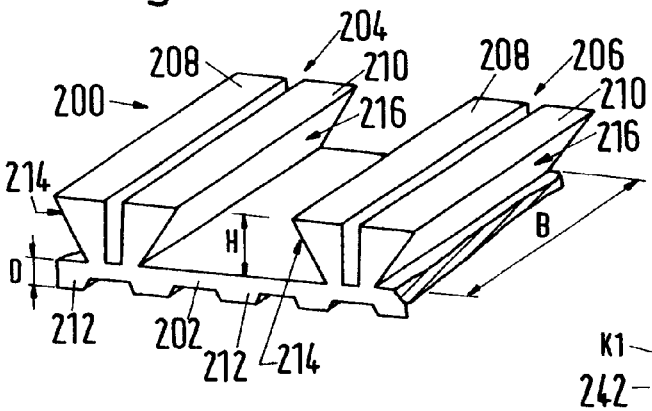
Fig.5
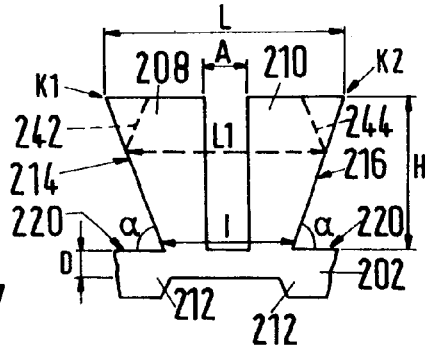
Fig.6
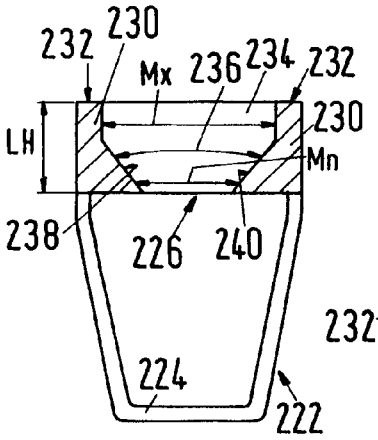
Fig.7
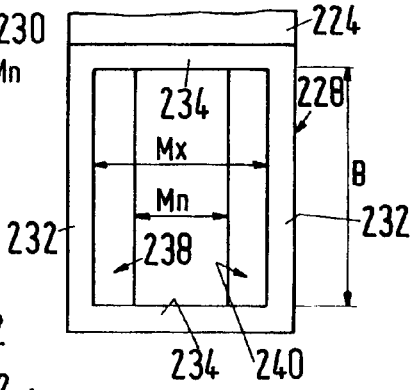
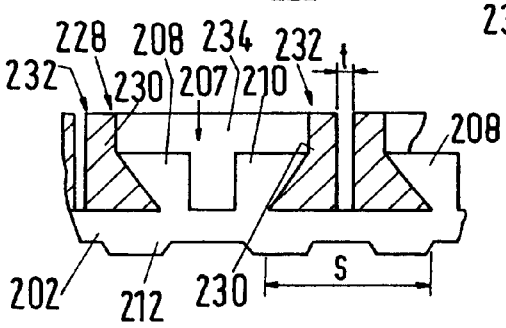
Fig.8
Fig.9
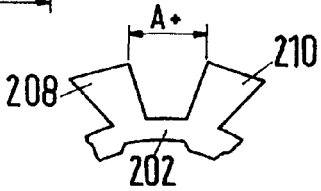

Fig.15
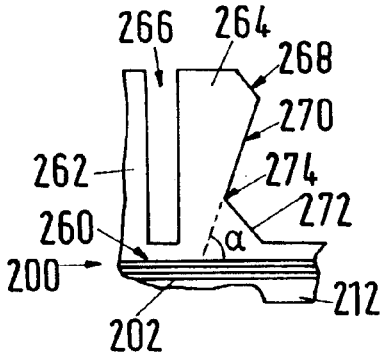
Fig.17
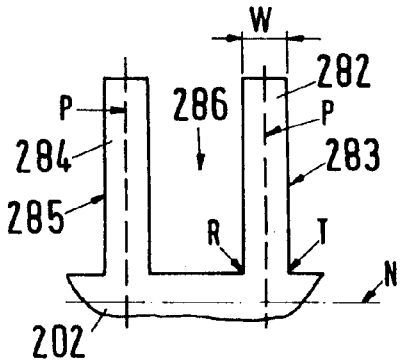
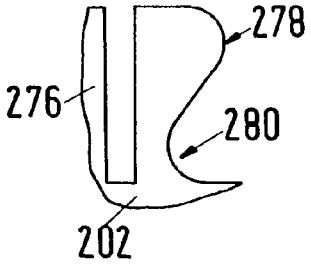
Fig.16
Fig.18
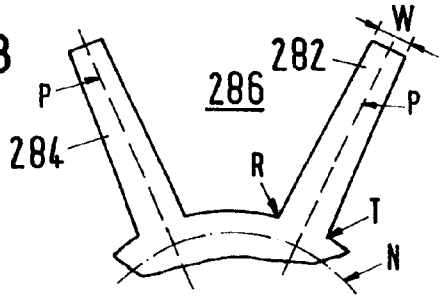
Fig.19
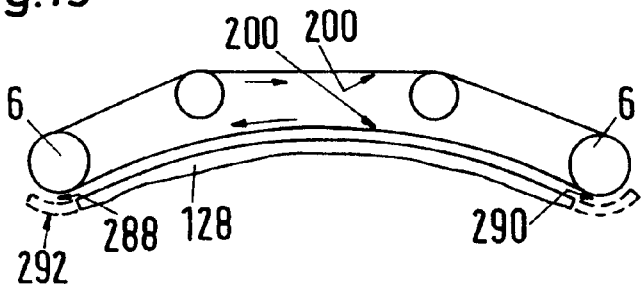

Fig.21
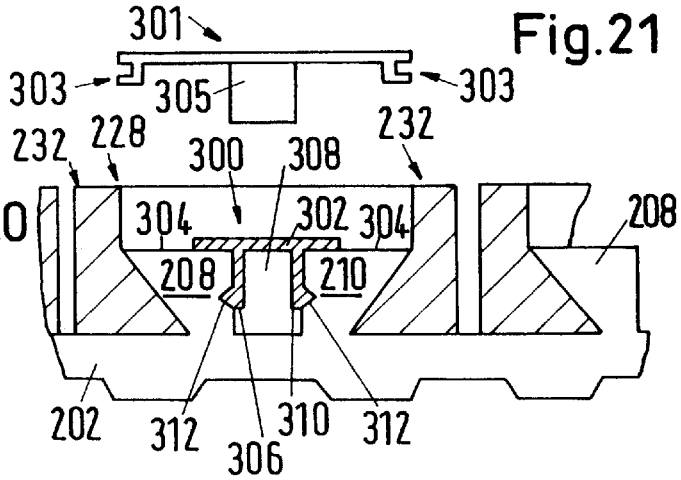
Fig.20
Fig.22
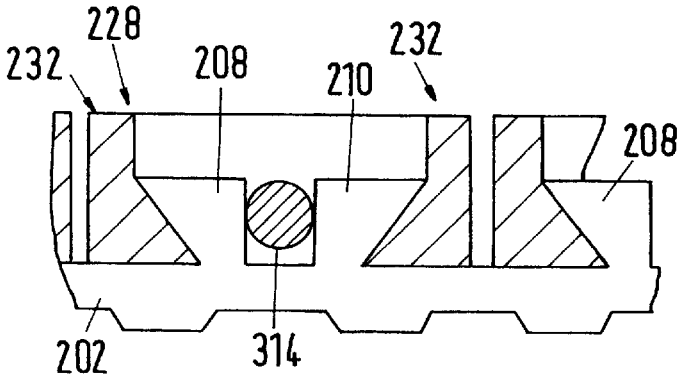
Fig.24
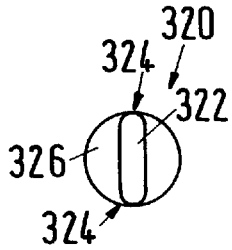
Fig.23
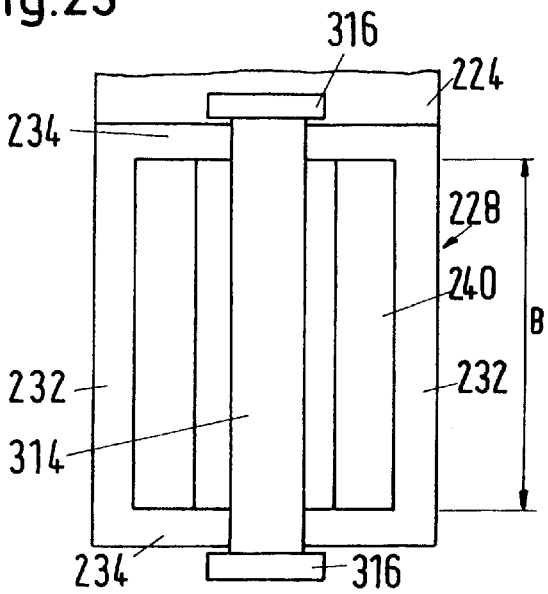
Fig.25
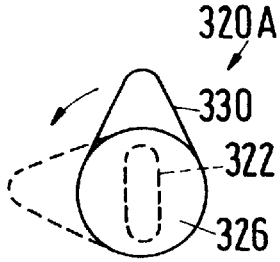

LATCHED SNAP-IN CONNECTION

BACKGROUND

The invention relates to the connection between a flat bar and a flexible drive belt in the flat arrangement of a revolving flat card. Such a connection is shown in EP-A-627507 and in EP-A-753610 (or U.S. Pat. No. 5,956,811).

The belt according to EP-A-627507 comprises fastening elements provided in pairs which form a snap-in connection with the flat bar. EP-A-753610 shows a special drive belt for the flat bars of a revolving flat card, the belt provided with connecting elements which are formed integrally with a flexible belt and are arranged in pairs. One pair of elements in a flat bar part can be received to form a snap-in connection. Each element comprises a transverse beam with an inclined surface, with the inclined surfaces of a pair of beams being directed in mutually opposite longitudinal directions of the flexible belt.

An object of the invention disclosed in EP-A-753610 was to propose embodiments with which mutually contradictory requirements could be fulfilled. For instance, the flat bar may remain rigidly connected in a predetermined position with the drive belt during the operation of the flat bar arrangement, or alternatively the flat bar can be easily removable and re-attachable if required (e.g. during maintenance).

Another object of the mentioned inventions allowed for a connection which did not require any additional fastening elements. It was noticed, however, that the latter goal was unreachable due to the high demands made by spinning, and threatened the fulfillment of the aforementioned target requirements.

SUMMARY

Various features and advantages of the invention will be set forth in part in the following description, or may be obvious from the description, or may be learned from the practice of the invention.

It is an object of the present invention to increase the operational reliability of a revolving flat arrangement with a snap-in connection between a drive belt and a flat bar as compared with the aforementioned art. Solutions to achieve this object are obtained from the combination according to the following claims.

The present invention includes a locking element that is incorporated into a drive belt assembly for a revolving flat card. A flexible belt of the drive assembly is provided with a pair of connecting elements formed integrally therewith. The connecting elements take the shape of a cross beam having an inclined surface. The locking element is disposed between the pair of connecting elements in order to prevent the connecting elements from approaching one another. Additionally, the locking element may be removed from the pair of connecting elements in order to allow the connecting elements to approach one another.

Alternatively, a pair of elastically deformable drive belts may be provide in a revolving flat unit, each having locking elements disposed thereon. A flat or a flat bar may be connected to the belt which has a connecting part that substantially prevents the divergence of the two holding elements of the drive belts.

The present invention also provides for a drive belt assembly as previously discussed which further has a head section with a locking bar that is disposed between two of the connecting elements to further lock the assembly into place.

The present arrangement is suitable for use with known flat bars with cuboid flat heads, and also with flat bars which are provided with bar-like slide pins, e.g. according to EP-A-567747.

Further advantages follow from the description below. The design is explained in closer detail on the basis of examples shown in the drawings. The explanation starts out from the embodiments according to EP-A-627507 and EP-A-753610, so that the latter solutions are explained first (as the "initial situation").

BRIEF DESCRIPTION OF THE DRAWINGS

The drawings show the following:

FIG. 4 shows a perspective representation of a drive belt according to EP-A-753610.

FIG. 5 shows a view of the belt according to FIG. 4.

FIG. 6 shows a cross-sectional view of the face side of a flat bar with an end-head portion arranged for cooperation with the elements according to FIG. 5.

FIG. 7 shows a plan view of the end-head portion according to FIG. 6.

FIG. 8 shows a longitudinal sectional view through the belt according to FIG. 5 with an end head carried according to FIG. 7 carried jointly.

FIG. 9 shows a view of the belt according to FIG. 5 with a curvature such that the holding forces of the connecting elements are increased.

FIG. 15 shows a plan view of an alternative to the belt body as shown in FIG. 5.

FIG. 16 shows another alternative of the belt body with an inclined surface which produces the holding of the flat bar.

FIG. 17 shows a belt body which works according to the holding principle described in connection with FIG. 9, but without the inclined holding surface.

FIG. 18 shows a diagram similar to FIG. 9 which shows a pair of beams represented in FIG. 17.

FIG. 19 shows a schematic representation of the path of a flat in a set of flats.

FIG. 20 shows a copy of FIG. 8 with a modification according to the present invention.

FIG. 21 shows schematically an alternative embodiment of the variant according to FIG. 20.

FIG. 22 shows a further copy of FIG. 8 with a second modification according to the present invention.

FIG. 23 shows a copy of FIG. 8 with a modification according to the embodiment shown in FIG. 22.

FIG. 24 shows a schematic representation of a variant of the embodiment shown in FIG. 22.

FIG. 25 shows a modification of the variant according to FIG. 24.

DETAILED DESCRIPTION

Figure 1:
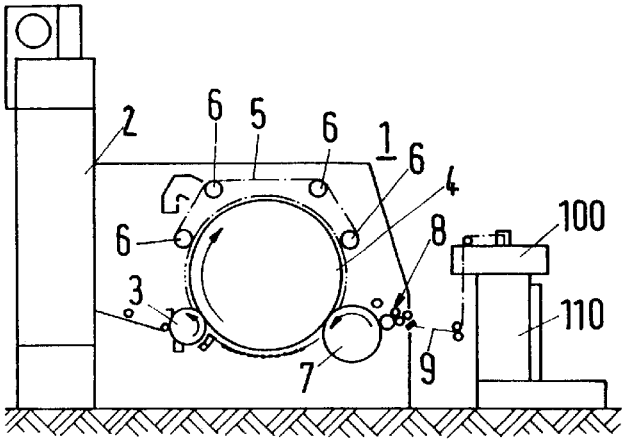
Fig.1 PRIOR ART
FIG. 1 shows a schematic view of a revolving flat card.

Reference will now be made in detail to embodiments of the invention, one or more examples of which are illustrated in the drawings. Each example is provided by way of explanation of the invention, and not meant as a limitation of the invention. For example, features illustrated or described as part of one embodiment can be used with another embodiment to yield still a third embodiment. It is intended that the present invention include these and other modifications and variations.

FIG. 1 shows a known revolving flat card 1, for example the carding machine C5I of the applicant, in a schematic view. Fiber material is supplied in the form of opened and cleaned flocks to a fiber tuft feeder 2, received by a licker-in 3 (also known as taker-in) as lap feed, transferred to a main cylinder 4 and parallelized by the flat of a revolving flat unit 5. The flats are driven via deflection rollers 6 in synchronicity or in the opposite direction to the direction of rotation of the main cylinder 4. Fibers from the non-woven material situated on the main cylinder 4 are taken up by a doffer 7 and formed into a card sliver 9 by an outlet section 8 consisting of various rollers. The card sliver 9 is deposited by a can coiler 100 in transport can 110 in cycloidal windings.

Figure 2:
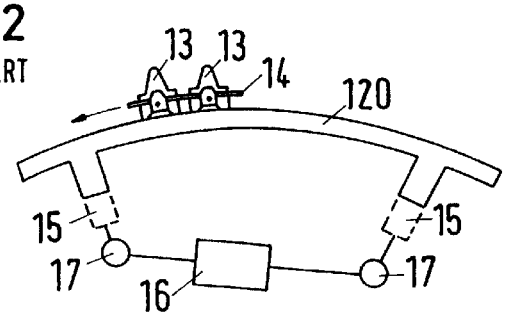
Fig.2 PRIOR ART
FIG. 2 shows a schematic representation of a part of the revolving flat arrangement of the carding machine according to FIG. 1.

FIG. 2 shows in a sectional view a flexible bend 120 of such a carding machine. Revolving flats 13 (of which only two are shown) are moved slowly by a toothed belt 14 and a drive (not shown) in synchronicity or in the opposite direction to the direction of rotation of the main cylinder 4. Adjusting members 15 are provided on the flexible bend 120 with which the distance of the revolving flat 13 to the cylinder surface (i.e. the so-called carding distance) can be set. The revolving flat unit of a carding machine according to DE-A-3835776, for example, comprises one hundred and six flat bars, of which forty-one are in the working position, i.e. they are in contact with the slideway.

Figure 3:
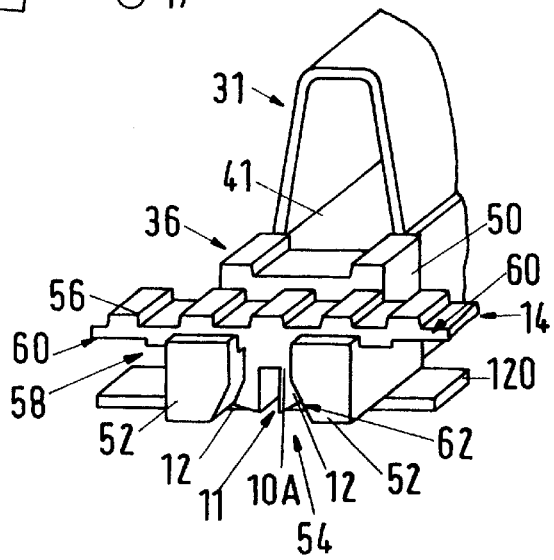
Fig.3 PRIOR ART
FIG. 3 shows a perspective view of the preferred embodiment according to EP-A-627507.

FIG. 3 shows the preferred embodiment according to EP-A-627507 for connecting flat bars with a (toothed) drive belt. A head element 36 of a flat bar 31 comprises a slide-in part 41 and a sliding section 50. The part 41 extends into the receiving section of a hollow profile and is fixed therein, e.g. according to EP-A-627507.

The sliding section 50 is guided in the working position of the flat bar along the flexible bend 120 and, during the return run, along a rail (not shown). The sliding section 50 is provided with two projections 52 which jointly form a receiving opening 54.

The drive belt 14 is arranged as a toothed belt. The teeth on an "inner surface" 56 of the belt (i.e. the surface with respect to the revolving closed path that faces inwardly) cooperates with drive wheels (not shown). On the "outside surface" 58 of the belt, which in the working position of the flat bars is positioned opposite of the flexible bend 120, has recesses 60 arranged in pairs. The recesses 60 each receive a projection 52. Between the recesses 60 of each pair, the belt 14 is provided with a projection 10A which is formed integrally with the belt 14. The projection 10A is received in the receiving opening 54 between the projections 52. The projection is provided with a slot 11, as a result of which two "legs" are formed. Each is provided in the base region with a cam 12. The projections 52 are each provided with an inclined surface 62 in order to better receive and hold the cams 12. The legs are elastic and can be compressed in order to form a snap-in connection with the head part 36 of the flat bar 31.

FIG. 4 shows an embodiment of a belt according to EP-A-753610, with only a short section of an oblong structure shown in the figure. The belt is indicated in its entirety with reference numeral 200. It comprises a body 202 which continues in the longitudinal direction, pairs 204 and 206 of connecting elements 208 and 210 as well as teeth 212. The belt 200 is cast in one piece. Reinforcements (e.g. filaments or wires, which are not shown) which extend in the longitudinal direction and can also be cast into the belt. The (matrix) material is preferably an elastomeric material such as polyurethane.

The body 202 is provided with a predetermined width B (e.g. in the range of 20 to 30 mm) and a predetermined thickness D (e.g. in the range of 1 to 3 mm). The thickness D can be chosen depending on the tensile forces to be transmitted, e.g. depending on the number of flat bars.

Every connecting element 208 and 210 consists of a cross-beam which extends over the entire width B of the body 202, namely perpendicular to the longitudinal direction of the body. Every beam 208 and 210 is provided with a predetermined height H (e.g. in the range of 3 to 8 mm). The beam 208 and 210 is wedge-shaped in the cross section, with the smaller "root" of the wedge 202 adjacent to the body 202 and the larger head portion remote from the body 202. The beams 208, 210 of a pair (e.g. of pair 204, which is also shown in FIG. 5) are disposed in a mirrored fashion opposite of one another. A distance A (referred to hereinafter as "nominal distance") between the two beams 208, 210 of the pair 204, is the same over the entire height of the beams 208, 210 when the body 202 is stretched (FIG. 5). in the illustrated example, the "slot" forming the distance extends downwardly up to the root of the beams 208, 210 .

Every beam may therefore comprise an inclined surface 214 or 216, and the inclined surfaces of a pair face in opposite longitudinal directions. In the illustrated example every inclined surface of a pair (e.g. pair 204, in FIG. 4) is situated opposite of an inclined surface of the adjacent pair (e.g. pair 206). The inclined surface 214 or 216 of a beam is angled with the adjacent surface 220 of body 202 at a predetermined angle a (e.g. in the range of 60 to 80 degrees) when the body 202 is in the stretched position. As will be explained below in closer detail, every beam 208 or 210 is rubber-elastic at least in the root zone, so that the beams can be pushed by means of suitable forces towards the inclined surfaces (or in the head zone generally) against each other in order to reduce their mutual distance in the head zone.

A belt body according to FIG. 4 or 5 is cut (or formed) for use to a predetermined overall length and the end parts of the body are then connected with each other in order to enable an endless belt for use in a revolving flat unit 5, 6 according to FIG. 1. A "revolving flat path" is defined for the flat bars which are connected with the belt during operation. Opposite the revolving flat path are the teeth 212 on the inner side of the endless belt. The pairs of beams 204, 206 stand on the outside surface 220.

The endless belt 200 first moves in the longitudinal direction so that each pair of beams 204, 206 is moved from the right to the left in FIGS. 4 and 5. Preferably, each pair of beams is arranged symmetrically so that it actually does not matter in which direction it is moved. The assumption of a certain direction simplifies the following description. In the "readiness state" (body 202 is stretched in a straight fashion, without any force exerted on the beam 208, 210) the distance in the longitudinal direction of the body 202 between the preceding free edge K1 of the beam pair 204 (FIG. 4) and the trailing free edge K2 of the same pair has a predetermined value "L" which can lie in the range of 12 to 25 mm. The distance "L" is referred to hereinafter as "span" of the beam pair. The respective distance "I" at the root of the beam 208, 210 is in the same state a smaller predetermined value which can lie in the range of 9 to 22 mm.

A flat bar which cooperates with this belt is indicated with the reference numeral 222 in FIG. 6, and comprises a hollow profile 224 and two end heads 226, only one of which is shown in FIGS. 6 and 7. Every end head 226 comprises a connecting part (not visible in these figures; see insert part 41 in FIG. 3) which is pressed into the respective end part of profile 224 and is fixed therein. The preferred design for fastening the end heads 226 in the profile 224 has been described in EP-A-627527. At each end of the profile a sliding block/clamp part 228 (FIG. 7) of the respective end head 226 projects out of the end of the profile. The part 228 comprises two rails 230 (FIG. 6) which extend in the longitudinal direction of the bar 222. These rails 230 each form a sliding surface 232 which slides along the sliding surface of the flexible bend when the bar 222 is in the working position. The rails 230 are formed integrally with cross-beams 234 which together with the rails form a receiving means of predetermined dimension for the respective elements of the belt 200. The size of this opening in the longitudinal direction of the rails 230 preferably corresponds to the belt width (or the beam length) B (see FIG. 7 and FIG. 4). It is thus ensured that the belts of the revolving flat unit and the flat bar of the unit mutually center each other laterally.

The clamping and connecting function is fulfilled by two rail parts 236 (FIG. 6) which are also wedge-shaped in their cross section, so that they are each provided with an inclined surface 238 and 240, respectively. The inclined surfaces 238, 240 are disposed so as to face each other and are provided with a predetermined minimum distance Mn (FIG. 7) considerably smaller than the span L (FIG. 5) of a pair of beams in the aforementioned state of readiness. The inclined surfaces are provided with a predetermined maximum distance Mx (FIG. 7) which is explained below. The distances Mn and Mx are designated below as the "opening widths" of the clamping part.

FIG. 8 shows a sliding block/clamp part 228 in connection with a pair of beams 207 of the belt 200. The clamp part has been snapped over the pair of beams, so that the inclined surfaces 238, 240 are in connection with the inclined surfaces 214, 216 of the beams. The height of each wedge-shaped part of the rails 230 is approximately equivalent to the height H of the beams 208, 210. The total height LH (FIG. 6) of each rail 230 is considerably larger, so that the sliding surfaces 232 (in the arrangement according to FIG. 8) lie far above the beams 208, 210.

Every flat bar 222 is connected in the same manner with a pair of beams. The distance between adjacent flat bars 222 is predetermined and should be kept as small as possible. This distance is designated in FIG. 8 with the reference numeral "t". The distance t is naturally given by the construction of the rails 230 and the distance between adjacent pairs of beams. The latter distance is also predetermined and is at the roots of the beams 208, 210 (on the surface 220 of body 202) and designated the value "S" (FIG. 8) which is in the range of 14 to 27 mm.

Every snap-in connection according to FIG. 8 was designed to produce holding forces in such a way that the following minimum requirements are fulfilled:

- The sliding surfaces 232 (FIG. 7) sit in close fit and in a stable fashion on the sliding surfaces of the flexible bends (resistance against moments of tilt).
- The drive forces are reliably transmitted by belt 200 onto the flat bar 222 in the operating position and during the return run.
- The flat bars 222 are held securely by the belt 200 at the deflection points.

Measurements made according to EP-A-753610 shall be repeated here, with additional measurements taken according to the present invention in order to ensure that the requirements are always fulfilled in spinning operation. The additional measurements are explained below by reference to the FIGS. 20 through 25.

The width Mn of the input opening of the clamp is preferably approximately as large as the dimension "I" (FIG. 5) at the root of the beams 208, 210. The maximum width Mx of the clamp is preferably not as large as the span L of the pair of beams. In the mounted state (FIG. 8) the distance of the beams in the head zone is slightly reduced with respect to the nominal distance A, which means that the rails 230 also push the beams 208, 210 against each other in the fully latched state. The beams 208, 210 are pushed together even more during the oversnapping of the clamp as will be explained below with reference to FIGS. 10 through 12.

The holding forces are also influenced by the "degree of bending" of the belt body, as will be first explained in relation to FIG. 9. FIGS. 4, 5 and 8 all show (for reasons of simplicity) the belt body 200 in the stretched state. The revolving flat path is not straight at any place and comprises in the end zones two partial sections at the deflection rollers which require a considerable bending of the belt body. The outside surface of the body 202 with the beams 208, 210 is moved in a convex manner. The effect of the bending in the absence of a clamp is shown in FIG. 9. The beams 208, 210 of each pair are pulled apart, especially in the head zone, so that the distance between the beams increases from the nominal distance A (FIG. 5) to A+ (FIG. 9). Such an increase is not possible in the presence of a clamp, because the rails 230 are strong enough to withstand the "elastic forces" of the pair of beams 208, 210. The elastic forces produce a considerable increase of the holding forces while a pair of beams carrying a flat bar moves about a deflection roller 6 (FIG. 1).

The snap-in connection also allows the release of a flat bar (e.g. during the maintenance of the flat bars or for checking a flat bar) and the (re-)attachment of the bar. This is possible during the (still) running, revolving flat unit. The attachment of the bar is shown schematically in FIG. 10. One of the inclined surfaces of the clamp (in the illustrated example it is the surface 238) is brought into contact at first with the inclined surface (214 in FIG. 10) of the respective beam (208 in FIG. 10). The flat bar 222 is inclined in such a way that the edge K1 at the other rail of the clamp can be brought into contact with the head of the other beam 210. When pressure is applied on the still free-standing rail, the beam 210 is elastically deformed in such a way that the edge K1 can move past the edge K2 (FIG. 5), which latches the clamp.

Figure 10:
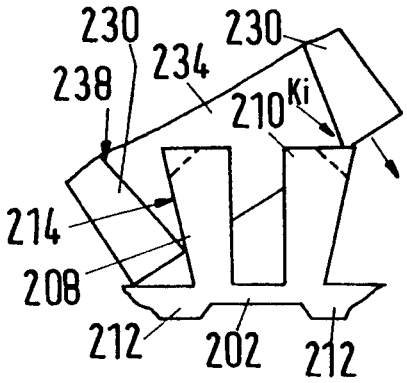
FIG. 10 shows a view of the part according to FIG. 7 when brought together with a belt according to FIG. 5.
Figure 11:
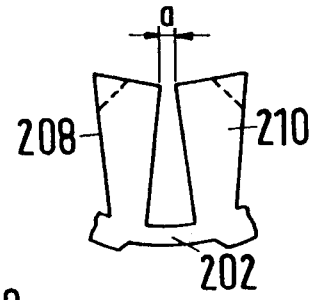
FIG. 11 shows a view of the belt according to FIG. 5 with a curvature such that the distance between the connecting elements is decreased.

The simple beam head shape according to FIGS. 4, 8 and 10 comprises a face surface which is situated in a single plane. If this shape is chosen, one must expect problems both during the "pressing in" as well as with damage to edges K1 and K2. A partial solution to this problem has been indicated with the broken lines in FIG. 5, where the face surface has been inclined in order to form guide surfaces 242, 244. As compared to the variant with the unbroken lines, the span of the pair of beams decreases to L1. The transition between a guide surface and the respective inclined surface of the beam is preferably more rounded off, instead of being edge-shaped. This constructional exception simplifies the pressing in accordance with FIG. 10. The attachment as well as the detachment of a flat bar may, under certain circumstances, still be somewhat cumbersome for an operator. This problem can be solved elegantly by reversing the effect according to FIG. 9. This is schematically shown in FIG. 11.

Figure 12:
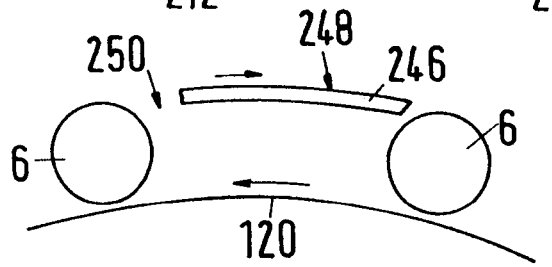
FIG. 12 shows a view of the guide means for a drive belt of the revolving flat unit in order to explain the production of the curvature according to FIG. 11.

A bending of the belt body 202 with the beams 208, 210 on the concave surface of the belt brings the head zones of the beams together. Beam distance is reduced with respect to the nominal distance A (FIG. 5) to "a" (FIG. 11) or even cancelled. The span L or L1 is reduced accordingly, which helps facilitate the pressing in of the bar. A minimum bending of this kind can be produced when a flat bar 222 is placed on the sliding surface of the flexible bend 120 (FIG. 12). The respective loosening of the holding forces occurs at a location, however, unsuitable for attachment or removal. The latter function should be carried out on the return path 246. In this case the belt 202 is preferably supported by a return rail 248 which may even be provided with a slight curvature in the "wrong" direction. At least one position (e.g. 250, FIG. 12) is provided with no guidance for the belt so that the operator can produce the desired bending of the belt (with or without tools) himself or herself. This "mounting location" is preferably situated in the zone where a belt part during its movement leaves the revolving flat path along a deflection roller and the return rail has not yet been reached. The mounting location can also be positioned at another place on the return path, or it is even possible to distribute a number of mounting locations along the path. Desirably, the mounting locations for the two belts of a revolving flat unit correspond to one another.

Figure 13:
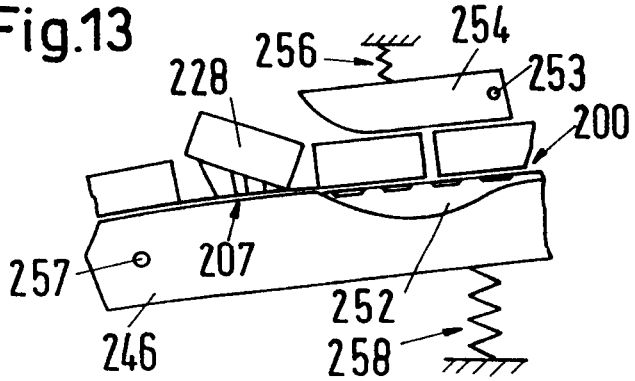
FIG. 13 shows a view of a modification of the arrangement shown in FIG. 12.

FIG. 13 shows a modification of the arrangement according to FIG. 12 where the return rail 246 is provided with a recess 252 and the recess 252 is associated with a securing plate 254. When a pair of beams (e.g. 207) approaches plate 254 with an incorrectly mounted flat bar with the sliding head 228, the plate 254 presses the clamp part of the sliding head 228 downwardly over the pair of beams. For this purpose the plate 254 is carried rotatably about a shaft 253 and pretensioned by an elastic means (e.g. spring 256) in the direction of recess 252. The plate usually maintains a predetermined distance from the return rail, for instance due to a stop (which is not shown). During the latching of a clamp part, the plate is pushed away upwardly (against the pretension) by the return rail 246.

The rail 246 is carried rotatably about a shaft 257 and is upwardly pretensioned by an elastic means 258 (e.g. a spring) in order to tension the belt 200. The belt is usually not deflected into the recess 252. Instead, the recess is bridged by the belt. A deflection to the recess occurs under pressure of plate 254 when the plate 254 is pushed upwardly as has previously described. The deflection leads to the effect as has already been described in connection with FIG. 11.

Both return rails (one each per machine side) need to be provided with an apparatus in order to bring the elements of the snap-in connection into engagement with each other. In cases where the apparatus comprises a recess and plate according to FIG. 13, the two apparatuses must snap in the elements simultaneously.

Figure 14:
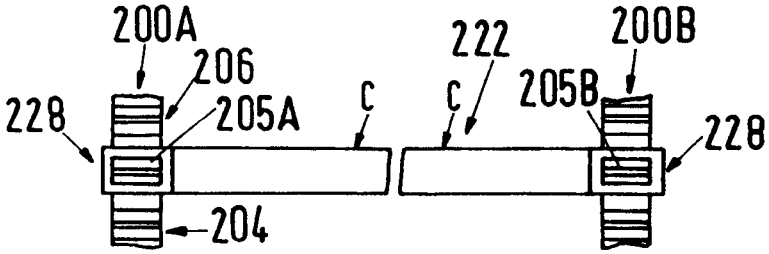
FIG. 14 shows a flat bar carried between two belts of the kind shown in FIG. 4.

FIG. 14 shows lateral parts of a flat bar 222 which is guided accordingly between two belts 200A, 200B at opposite sides of the card (not shown in FIG. 14, cf. FIG. 1). The central part of the flat bar has a breakthrough. The flat bar 222 is shown, as seen from above, on its "return path". Here the flat clothing C is moving upwardly for cleaning so that the profiles 31 (FIG. 3) are not shown. The sliding blocks 228 of the end heads are shown. Each of the sliding blocks is fastened in a beam pair 205A, 205B to its belt. The pairs of beams which are designated with 204, 206 are situated on belt 200A adjacent to beam pair 205A are not provided with flat bars. The flat bar 222 can be the first flat, for example, which is placed on the belt during mounting or subsequent maintenance.

In FIG. 15, the belt is indicated again with reference numeral 200 and comprises a body part 200 with teeth 212. The body part 200 usually comprises supporting elements which extend in the longitudinal direction and are indicated only schematically with reference numerals 260. A pair of beams 262, 264 is shown in a side view. Only beam 264 is shown in its entirety. The beams 262, 264 of the pair are separated by a slot 266 which extends from the outer (free) end of the beams up to the body part 202 of the belt. The side of beam 264 opposite of beam 262 comprises a guide surface 268 at its outer end, an inclined holding surface 270 which is similar to surface 216 in FIG. 4, and an inclined base part 272. The inclined base part 272 is connected to the inclined holding surface 270 via a link 274. When the flat is latched onto the belt, the beam 264 bends around the link 274 instead of around a root as in the case of the beams 208, 210 (FIG. 4). Moreover, the holding surface 270 forms with the belt length in a straight position as shown in FIG. 15 an angle $\alpha$ (in the range of 60 to 80 degrees).

The embodiment shown in FIG. 15 shows a sharp pointed edge where two surfaces meet. This is not the preferred embodiment for reasons that have already been explained. Such edges are preferably rounded off, especially when there is a likelihood that the beam is cut through at the clamping or fixed elements. A rounding off of the beam surfaces can lead to a shape as indicated with reference numeral 276 in FIG. 16 where the holding surface 278 is rounded off. It will be relatively difficult to achieve a favorable cooperation between the sliding block and the beam in the last mentioned embodiment, partly for the reason that it is relatively difficult to adjust the surfaces on the sliding blocks according to the rounded-off beams. The holding surface of each beam preferably extends up to the root 280 of the beam (where it borders the body part 202 of belt 200) for reasons which will be explained below in closer detail by reference to FIGS. 17 and 18.

FIG. 17 shows a pair of beams 282, 284, with each beam having a simple rectangular profile. The beams are separated by a slot 286. Every beam 282, 284 is integrated with the body part 202 of the belt or fixedly attached. The pair of beams is received by a sliding block, clamping or fastening means similar to those as already described above. However, lateral surfaces may be present which are adjusted to receiving the beam surfaces 283, 285. The direction of movement of the flat bars is shown in FIG. 19 with arrows. This direction has been assumed merely for purposes of graphical illustration and description. The flat bars can nevertheless move in the opposite direction. During movement of the flat bars along the flexible bend 120 (cf. FIG. 2) or on the opposite side when the belt returns, no problems exist concerning the holding of the flat bars relative to the belt.

There should also not be any problems when the belt 200 is bent, as is shown in FIG. 18, and tends to spread apart the beams 282, 284, where the slot 286 is extended over its outer end. Such spreading is shown in FIG. 18. This is actually prevented because the pair of beams is properly fastened in its sliding block, and because the beams continuously rest on the lateral surfaces of the sliding blocks. The "striving" towards a spreading of the beams produces lateral forces on the walls of the sliding block, and resulting friction may be sufficient to hold the flat bar for such a time until the belt is bent in the respective sense.

Problems arise in the transition zones 288, 290 (FIG. 19) where the belt bends from a curved shape (as defined by the flexible bend 128) to another (as defined by the deflection rollers 6, cf. FIG. 1) so that the frictional forces cannot arise on the flat bar. At the same time gravity tends to pull the flat away from the belt. In order to overcome the problems in zone 288 one could use a short extension piece 292 (shown with the broken line). This creates a continuous guidance of each flat when it leaves the flexible bend 128 until the belt is bent according to the curvature of the deflection rollers 6. Here, the belt is again held by frictional forces produced by a respective pair of beams 282, 284. A similar extension piece can be provided in the zone 290 as the frictional forces produced by the pair of beams are reduced before the flat bar rests on the flexible bend 128.

A simple beam (as shown in FIGS. 17 and 18) is suitable for the purpose of describing the holding effect in closer detail. It is assumed that each beam comprises a central longitudinal plane P (plane of symmetry) and that the body part 202 of the belt comprises a neutral plane N, i.e. a plane in which a belt fabric is principally not distorted when the belt is bent about an axis rectangularly to its length, but parallel to its width. In the form as shown in FIG. 17 (belt 202 is stretched in a straight fashion) the plane P of each beam is disposed at a right angle to the neutral plane N of the belt. In the state according to FIG. 18, the axis of the belt curvature is not shown, but it is disposed on the side of the belt averted from the beams 282, 284. Here, the belt fabric 200 is extended above the neutral plane N in FIG. 18 (relative to FIG. 17) and compressed below the neutral plane.

The belt fabric which lies in the plane R-T in FIG. 17 (at the "root" of beam 282 where the beam is adjacent to the belt body) is stretched in a bend R-T in FIG. 18 with a degree of bending which arises with the position of the bending axis (not shown). When the belt moves about the deflection roller 6, the rotational shaft of the deflection roller constitutes the bending axis. For purposes of explanation, it is assumed that the pair of beams 282, 284 does not carry any flats at the time of movement about the deflection roller 6 so that the beams of the pair are free to diverge as shown in FIG. 18.

The plane of symmetry P of the beam 282 will intersect the bending axis. Outside (radially outwardly) of the bend R-T there are practically no forces in the material of the belt fabric 200 which would cause an extension of the belt so that the width W of the outer beam end remains unchanged in comparison with FIG. 17. Each beam 282, 284 principally extends radially from the belt 200. Accordingly, it is not necessary that the beams are made integrally with the body part 202 of the belt. The beams can be designed separately and fastened thereafter to the belt in an appropriate manner. Usually, the body part of the belt is arranged integrally with the beam (and teeth 212).

In practice during spinning operations, the problems of the following kind can occur:

1. During the mounting (also in the spinning room, e.g. after changing a set of flats) the belt is not yet tensioned after attaching the first flat bars. The connections between the clamp and the beam of the first bars are relatively loose. The first bars can fall into the deflection zone before the other bars are attached to the belt. Even if this occurs only very rarely and does not cause any "damage", the mounting work is still considerably disturbed. In view of this risk, the mounting must be performed generally with great care that cannot be ensured in every plant.

2. The general problem of dirt accumulation in the spinning mill also plays a role in connection with the snap-in connection. Dirt accumulations can build up in the snap-in connection between the belt and the flat head which tends to loosen or "burst" the snap-in connection. This tendency is supported in certain zones of the path of movement by the aforementioned loosening of the connection due to the bending of the belt. The effect may, under certain circumstances, have such consequences that the flat head "jumps out" of the snap-in connection. Even if this happens only once per year in a single carding machine, the risk is still unacceptable for a spinning mill.

3. The problem of a tilting moment acting on the flat head has already been mentioned within the scope of the description above. This problem is increased by certain auxiliary devices in the carding machine. For instance the flat cleaning means (e.g. according to DE-Gbm-94 14196) or a grinding device for the flat clothing (e.g. according to EP-A-1019218 or WO 00/13850) may increase this problem. These devices are usually provided in the return area. The snap-in connection usually acts rigidly in this zone. As has already been shown in the preceding paragraph, the operating conditions in the spinning mill can have a negative effect over time. The tilting moment produced by the concentration of forces in the zone of an auxiliary device can lead to the release of the flat bar.

4. The material of a flexible belt is naturally susceptible to wear and tear in comparison with metallic fastening elements as previously stated in connection with FIG. 5. If the belt is not treated carefully or exchanged in due time, the holding performance of individual snap-in connections can be impaired. This risk can prove to be unacceptable, especially in combination with the aforementioned effects.

One object of the invention is to remedy this situation. The snap-in connection may be supplemented by a locking element. Exemplary embodiments are explained below by reference to FIGS. 20 through 29. The preceding description of FIGS. 5 to 8 applies in this situation so that only a locking element needs to be newly treated. According to the concept shown in these examples, the locking element is chosen in such a way that it prevents the mutual approach of the beams 208, 210 which is required for a loosening of the snap-in connection.

In the example according to FIG. 20, every sliding block/clamp part 228 is associated with a respective locking element in the form of a so-called clip 300 which is in engagement with the beam 208, 210 by a separate snap-in connection. The clip 300 is made of one piece and comprises a "plate" 302 which sits flush on the face surfaces 304 of beams 208, 210. A first leg 306 extends into the slot 308 between the beam 208, 210 and stands in contact with the side surfaces of the beam 208. A second leg 310 extends into the slot 308 and thereby remains in contact with the side surfaces of beam 210. Every leg is provided with a cam 312 which extends parallel to the longitudinal direction of the beams 208, 210 and snaps into a respective groove (not especially indicated) in the respective beam 208 or 210.

The legs 306, 310 are elastically deformable with respect to plate 302 so that they can be compressed when the clip needs to be snapped in. The distance between the legs 306, 310 can increase slightly with increasing distance from the plate in order to ensure that the clip does not loosen during operation. The distance between the legs 306, 310 in the vicinity of the plate is preferably equal to the nominal distance A (FIG. 5). Since the legs cannot be easily bent close to plate 302 the bending forces are transmitted directly to the plate. The distance between beams 208, 210 cannot be reduced below the nominal distance A as long as the clip 300 remains snapped in. The snap-in connection between the flat bar and the belt body 202 is thus locked. The clip needs to be removed in order to allow the release of the flat bar from the belt.

The removal of the clip may require the destruction of the clip. The removed clip needs to be replaced in order to lock a snap-in connection again between the flat bar and the belt at the same place. The clip 300 can practically cover the slot between the beam 208, 210. It is also possible to leave open a short section of the slot so that a tool can be introduced into the slot in order to remove the snap-in connection between the clip and the beam.

FIG. 21 schematically shows an alternative to clip 300 in the form of a cover 301 for the sliding block/clamp part 228. This cover 301 is provided with elastically deformable fastening claws 303 which can latch into openings (not shown) in part 228 between the sliding surface 232 and the beam 208, 210. The surface of the cover 301 facing the beam is provided with a bar 305 which takes up a position between beams 208, 210. The slot in the zone of the free ends of the beam is filled, and thus the snap-in connection is latched. The cover 301 also protects the snap-in connection against fiber fly and dust from the ambient environment of the spinning mill. The bar could also be provided with cams (not shown) similar to cams 312 and thus form a snap-in connection with the beams directly. This connection can replace or supplement the aforementioned claws. When the cross-beams 234 (FIG. 7) have a slightly lower height with respect to the rails 232, the cover can be provided with claws which cooperate with fastening elements on the outside surfaces of the cross-beams in order to rigidly (but still detachably) attach the cover to the sliding block/clamp part.

In the variant according to FIGS. 22 and 23, the locking element is in the form of a bolt 314 which extends between the beams 208, 210 and through respective holes (not shown) in the cross-beams 234. Suitable securing elements 316 are provided outside of the sliding block/clamp part 228 which tightly hold the bolt 314 in a locking position. The locking function is substantially the same as that of the clip 300, with the bolt 314 introduced between the beam 208, 210 once the snap-in connection between the flat bar and the belt is produced. The securing elements 316 are then attached. These elements can be arranged in such a way that they need to be destroyed in order in order to allow for the removal of the belt (the unlatching).

FIG. 24 shows a variant of the arrangement according to FIG. 22. Here it is not necessary or possible to remove the locking element for unlatching because it is rigidly in engagement with the sliding block/clamp part. In this case, the locking element 320 comprises a part 322 which, like the bolt 314 (FIG. 23), extends between the beam 208, 210 (not shown in FIG. 24) with the part 322 not formed circular in its cross section but as a flat bar with rounded side surfaces 324. The bar 322 is shaped with end parts 326 (only one end part 326 is visible in FIG. 24) which are received rotatably in the cross-beams 234 (cf. FIG. 23). The bar 322 is thus rotatable with the end parts 326 by an angle of approximately 90° between an unlocking position (shown in FIG. 24) and a locking position (not shown). In the locking position the side surfaces 324 each come into contact with a beam 208 or 210 and thus fulfill the locking function which has already been explained in connection with FIG. 20.

FIG. 25 shows a further variant of the principle according to FIG. 24. The locking element 320A also comprises in this case a bar-shaped part 322 and end parts 326 (only one end part is visible). One end part 326 is provided outside of the sliding block/clamp part 228 with a nose 330 which can be in contact with a radial cam during movement of the flat bar along its path of movement. As a result of contact of the nose 330 with the radial cam, the nose is moved from the stand-by position (shown in the unbroken line) to the operating position (shown in the broken line). This moves part 322 to the locking position and holds it there until an opening in the radial cam allows the return swivel of the nose to its starting position.

Figure 26:
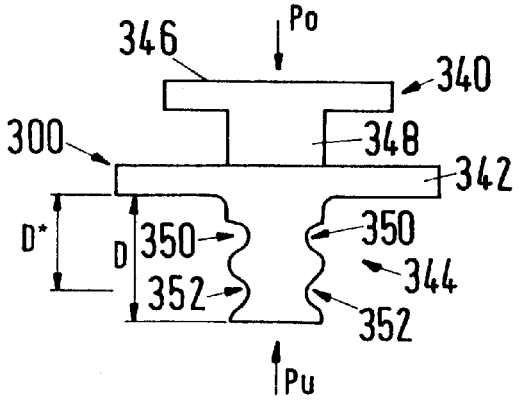
FIG. 26 shows a view of a further embodiment of the present invention.
Figure 27:
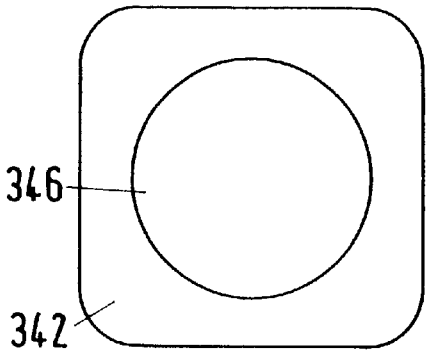
FIG. 27 shows the embodiment according to FIG. 26 as viewed in the direction of arrow Po.
Figure 28:
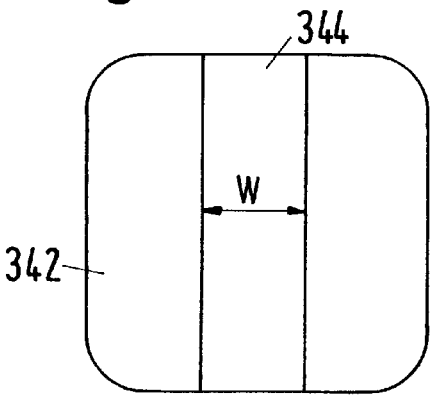
FIG. 28 shows the embodiment according to FIG. 26 as viewed in the direction of arrow Pu.
Figure 29:
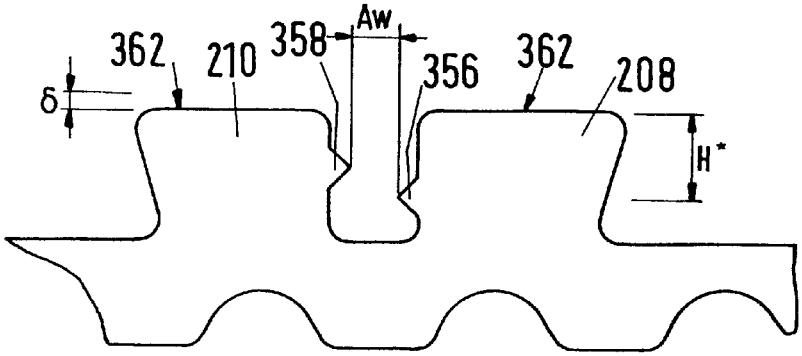
FIG. 29 shows a cross-sectional view of a belt portion with connecting elements which can cooperate with the embodiment according to FIG. 26.

The locking element 300 according to the FIGS. 26 to 28 is preferably made of one piece, in one embodiment being cast of plastic. The element comprises a "mushroom-shaped" handle 340, a rectangular flange 342, and a bar-shaped locking bar 344.

The outside dimension of the flange 342 is smaller than the distance Mx (FIG. 7) so that the element 300 can be introduced easily between the rails 230. The length of the locking bar 344 is equal to the diameter of the outside dimension of the flange 340. The width W (FIG. 28) of the locking bar 344 is slightly smaller than the width A (FIG. 5) of slot 308 (FIG. 20) between adjacent beams 208, 210. When the locking bar 344 is aligned in the longitudinal direction of the slot 308, the locking bar can be introduced between the beams 208, 210 of a pair of beams to prevent the beams from approaching one another until the locking bar is removed. The depth D of the locking bar 344 is preferably slightly smaller than the height H (FIG. 5) of the beams 208, 210.

The handle 340 consists of a button-like head section 346 and a handle 348. A tool can be introduced between the head section 346 and the flange 342 in order to facilitate the removal of the locking element 300 from a sliding block/clamp part 228 (FIG. 7). The length of the handle 348 is chosen in such a way that the head section 346 does not project from the sliding block. The sliding block is preferably provided with a sliding layer, e.g. according to DE 19834893.

For the sake of simplicity, the element 300 is described further in the illustrated position (with the handle 340 at the top). From the preceding description it will be clear, however, that during operation the element 300 needs to work with the handle below.

Every side surface of the locking bar 344 is preferably provided with an upper groove 350 and a lower groove 352. In a preferred embodiment (FIG. 29) the mutually opposite side surfaces of the beams 208,210 are formed with bulges which can each engage in a groove 350 or 352 depending on the locking state. The beam 208 comprises a lower bulge 356 for cooperating with a groove 352. The beam 210 comprises an upper bulge 358 for cooperation with another groove 350. The distance Aw (FIG. 29) between the bulges 356, 358 is smaller than the width W of the locking bar so that during the latching of the bulges, a snap-in connection between the locking element 300 and the pair of beams 208, 210 is produced. Jumping out of the bulges can be avoided. It will be clear that the locking bar 344 can be provided with bulges instead of grooves, and the beams 208, 210 with grooves instead of bulges.

The distance D* (FIG. 26) between the lower grooves 352 and the lower side of the flange 342 is larger than the distance H* (FIG. 29) between the lower bulge 356 and the face surfaces 362 of the beams. Accordingly, in the locked state a narrow gap δ will also remain between the flange 342 (not shown in FIG. 29) and the face surfaces 362 so that the lock will securely latch and will not stand up on the surface 362.

Since the snap-in connection can be locked, it is not necessary to produce the holding forces merely on the basis of the elasticity or geometry of the beams. The holding forces which arise from the snap-in connection per se can thus be reduced (as compared with the arrangements according to EP-A-627507 or EP-A-753610) which further simplifies the attachment or removal of the flat bars. On the other hand, it is not necessary to provide securing rails at any place along the path of movement of the flat rods for the case that the snap-in connection itself does not hold.

It should be understood that the present invention includes various modifications that can be made to the embodiments of the latched snap-in connection described herein as come within the scope of the appended claims and their equivalents.

What is claimed is:

1. A drive belt assembly for a revolving flat card, comprising:

a flexible belt having at least a pair of connecting elements formed integrally with the belt, the connecting elements comprising a cross-beam with an inclined surface, the connecting elements having a space therebetween and being deformable towards each other for a snap-fit connection into a correspondingly shaped opening in a head piece of a flat rod that is attachable to the flexible belt; and a locking element disposed between the pair of connecting elements in order to prevent the connecting elements of the pair from approaching one another once the connecting elements have been fitted into the opening in the flat rod head piece, the locking element removable from the pair of connecting elements to allow approaching of the connecting elements to one another for attachment and removal of the flat rod from the flexible belt.

2. The drive belt assembly of claim 1, wherein the flexible belt has at least two pairs of connecting elements, and the nominal distance between the closest cross-beams of each separate pair of connecting elements is at least 1 mm.

3. The drive belt assembly of claim 1, wherein the flexible belt has at least two pairs of connecting elements that are situated on a convex surface of the flexible belt, and wherein the distance between the two cross-beams of the pair of connecting elements increases when the flexible belt bends and the locking element is removed from the pair of connecting elements.

4. The drive belt assembly of claim 1, wherein the flexible belt has at least two pairs of connecting elements that are situated on a concave surface of the flexible belt, and wherein the distance between two of the cross-beams that form one of the connecting elements decreases when the flexible belt bends and the locking element is removed from the connecting elements.

5. A drive belt for flat bars of a revolving flat unit, comprising:

an elastically deformable body part having at least a pair of holding elements along the length of the body part, the two elements of the pair tending to approach one another or move apart from one another during bending of the body part when moved along a revolving path of a flat bar of a carding machine, the holding elements having a space therebetween and being deformable towards each other for a snap-fit connection into a correspondingly shaped opening in a head piece of a flat rod that is attachable to the drive belt; and a locking element disposed between the two elements of the pair of holding elements to prevent the mutual approach of the two elements once the holding elements have been fitted into the opening in the flat rod head piece.

6. The drive belt of claim 5, further comprising a flat having a connecting part that substantially prevents the divergence of the two elements.

7. A revolving flat unit, comprising:

a pair of elastically deformable drive belts each having at least a pair of holding elements along the length of a respective drive belt, the two elements of the pair tending to approach one another or move apart from one another during bending of the drive belts when moved along a revolving path, the elements of each pair of holding elements having a space therebetween and being deformable towards each other for a snap-fit connection into a correspondingly shaped opening in a connecting part of a flat;

locking elements disposed between the two elements of the pair of holding elements on each of the drive belts, the locking elements prevent the mutual approach of the two holding elements; and a flat removably connected to the belt having a connecting part in a snap-fit connection with the two holding elements substantially preventing the divergence of the two elements, the locking elements inserted between the two elements of each pair of the holding elements after connection of the flat to the belt.

8. The revolving flat unit of claim 7, wherein each locking element is attached to one of the connecting parts.

9. The revolving flat unit of claim 7, wherein each locking element is attached to one of the drive belts.

10. The revolving flat unit of claim 7, further comprising a flat bar carried by the pair of elastically deformable drive belts, and wherein the force of connection between each of the locking elements and the two holding elements is capable of holding half of the weight of the flat bar.

11. The revolving flat unit of claim 10, wherein the weight of the flat bar is between 3.3 pounds and 9 pounds.

12. The locking element as in claim 11, wherein the locking bar further comprises a form-fitting profile that establishes a snap-fit connection with a correspondingly shaped space between the connecting elements.

13. The locking element as in claim 12, wherein the form-fitting profile comprises any combination of grooves and bumps defined on the outer surface of the locking bar.

14. A drive belt assembly for a revolving flat card, comprising:

a drive belt having a pair of connecting elements;

a flat bar connected to the drive belt by a snap-in connection between the connecting elements and a correspondingly shaped recess in a connecting part of the flat bar; and a locking element disposed in a space between the connecting elements thereby preventing any inadvertent loosening of the snap-in connection.

15. The drive belt assembly of claim 14, wherein the locking element is held in an operating position.

16. The drive belt assembly of claim 14, wherein the locking element is fastened to the flat bar.

17. The drive belt assembly of claim 14, wherein the locking element is movably fastened on the flat bar, and wherein the locking element is movable between an operating position and a stand-by position.

18. A locking element configured for insertion between deformable connecting elements on a drive belt of a revolving flat assembly wherein the connecting elements form a snap-fit connection with connecting parts of flats that are removably attached to the drive belt, the locking element preventing deformation of the connecting elements towards each other after establishing the snap-fit connection, the locking element comprising:

a head section defining a handle for insertion and removal of the locking element between the connecting elements; and an elongated locking bar extending from the head section, the locking bar having a length and a shape so as to fit in a space between the connecting elements and prevent deformation of the connecting elements towards each other.

19. The locking element as in claim 18, further comprising a flange member disposed between the head section and the elongated locking bar.

20. The locking element as in claim 19, wherein the head section, the flange, and the locking bar are formed as a single unitary piece.

* * * * *